US007364403B2

(12) United States Patent
Wu et al.

(10) Patent No.: US 7,364,403 B2
(45) Date of Patent: Apr. 29, 2008

(54) LUBRICATING SYSTEM FOR A FAN

(75) Inventors: Shun-I Wu, Guangdong (CN); Kuo-Chu Hsieh, Guangdong (CN); Zhi-Ya Yang, Guangdong (CN)

(73) Assignees: Fu Zhun Precision Industry (Shen Zhen) Co., Ltd., Longhua Town, Bao'an District, Shenzhen, Guangdong Provice (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 296 days.

(21) Appl. No.: 11/162,949

(22) Filed: Sep. 29, 2005

(65) Prior Publication Data

US 2006/0257250 A1 Nov. 16, 2006

(30) Foreign Application Priority Data

May 13, 2005 (CN) ..... 2005 1 0034661

(51) Int. Cl.
*F04D 29/063* (2006.01)

(52) U.S. Cl. ..... 415/175; 415/229; 416/174; 417/423.13; 384/114; 384/397; 384/415

(58) Field of Classification Search ..... 415/111, 415/112, 175, 229, 230, 231; 416/174; 417/423.12, 417/423.13; 384/100, 114, 322, 397, 415
See application file for complete search history.

(56) References Cited

U.S. PATENT DOCUMENTS

| | | | | |
|---|---|---|---|---|
| 4,801,252 | A * | 1/1989 | Wrobel | 417/423.12 |
| 5,997,265 | A * | 12/1999 | Chung | 417/423.13 |
| 6,318,976 | B1 * | 11/2001 | Hsieh | 417/423.12 |
| 6,544,011 | B2 | 4/2003 | Hsieh | |
| 2006/0251350 | A1 * | 11/2006 | Hong et al. | 384/100 |

* cited by examiner

*Primary Examiner*—Christopher Verdier
(74) *Attorney, Agent, or Firm*—Winston Hsu

(57) ABSTRACT

A lubricating system for a fan (10) includes a lubricant storage space (17) formed at an end portion of the fan for receiving lubricant therein. A lubricant temporary retaining space (145) is defined at the other end portion of the fan for temporarily retaining the lubricant therein. A lubricant returning space (125) communicates the lubricant storage space with the lubricant temporary retaining space for enabling the lubricant to flow from the retaining space to the storage space. The returning space is defined in a tube (12) made of plastic, wherein a bearing (13) is mounted in the tube and a stator (15) is mounted around the tube.

17 Claims, 6 Drawing Sheets

LUBRICATING SYSTEM FOR A FAN

FIELD OF THE INVENTION

The present invention relates generally to a heat dissipating fan, and more particularly to a lubricating system for the heat dissipating fan.

DESCRIPTION OF RELATED ART

A fan includes a fan frame, a tube formed at a middle portion of the frame, a bearing disposed in the tube, and a shaft rotatably mounted to a bearing hole of the bearing. Lubricant oil is filled in the tube to carry out lubrication between the bearing and the shaft.

During operation of the fan, lubricant oil stored at a bottom end of the tube will go up to a top end of the bearing by a pump force activated by a relative rotation of the shaft to the bearing. The oil may escape from the tube from the top end of the bearing. When this happens, a sufficient lubrication cannot be obtained between the shaft and the bearing, and a friction between the shaft and the bearing is increased, which finally may reduce the life term of the fan. So a lubricating system of good oil retaining capability is needed by the fan for satisfying the requirement of the long-term life of the fan.

In order to prevent the oil from leakage from the top end of the bearing, a plurality of oil returning grooves is defined in an outer periphery wall of the bearing for facilitating the oil driven to the top end of the bearing to flow downwardly back to the bottom end thereof. As the oil repeatedly goes up to the top end of the bearing and goes back down to the bottom end of the bearing, a circulating lubrication loop for the shaft and the bearing is formed.

In this lubricating system, the oil returning grooves are formed in the outer periphery wall of the bearing, which causes the manufacture of the bearing to be complicated and accordingly expensive.

In view of the above-mentioned problems of the lubricating system of the fan, there is a need for a lubricating system having good oil retaining capability and low manufacturing cost.

SUMMARY OF INVENTION

The present invention relates to a lubricating system for a fan. According to an embodiment of the present invention, the lubricating system includes a lubricant storage space formed at a bottom end portion of the fan for receiving lubricant therein. A lubricant temporary retaining space is defined at a top end portion of the fan for temporarily retaining the lubricant therein. A lubricant returning space communicates the lubricant storage space with the lubricant temporary retaining space, whereby the lubricant can flow from the retaining space to the storage space via the returning space. The returning space is defined in a tube made of plastic. A bearing is mounted in the tube. A stator is mounted around the tube. A rotor has a shaft which is rotatably fitted in the bearing. The rotor has a hub to which a top of the shaft is secured. The hub has fan blades formed at an outer periphery thereof. The retaining space is defined in an annular wall formed by the hub and surrounding the top end of the shaft of the rotor.

Other advantages and novel features of the present invention will become more apparent from the following detailed description of preferred embodiments when taken in conjunction with the accompanying drawings, in which:

DETAILED DESCRIPTION

Figure 1:
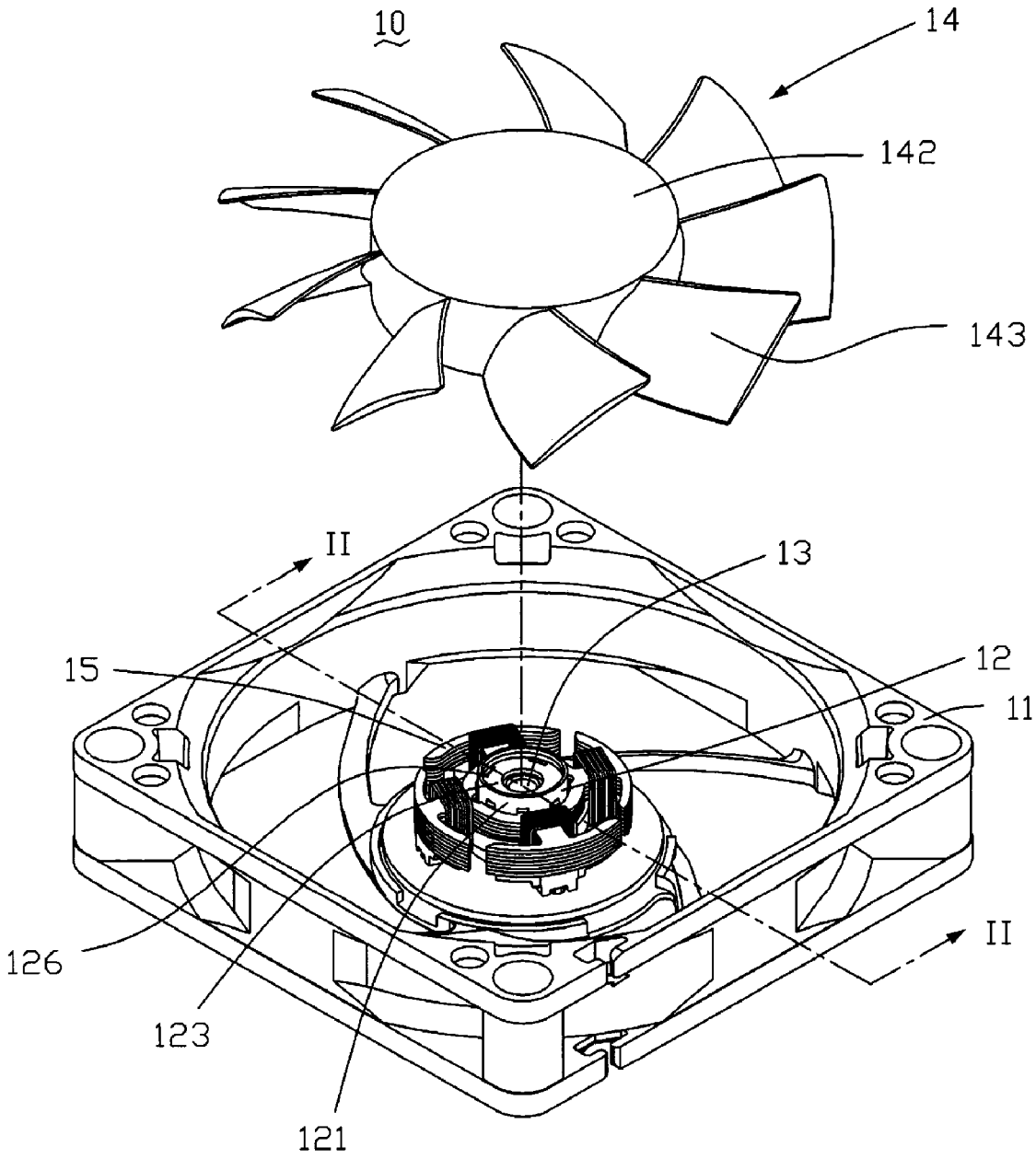
FIG. 1 is an exploded, isometric view of a heat dissipating fan with a lubricating system in accordance with a preferred embodiment of the present invention.
Figure 2:
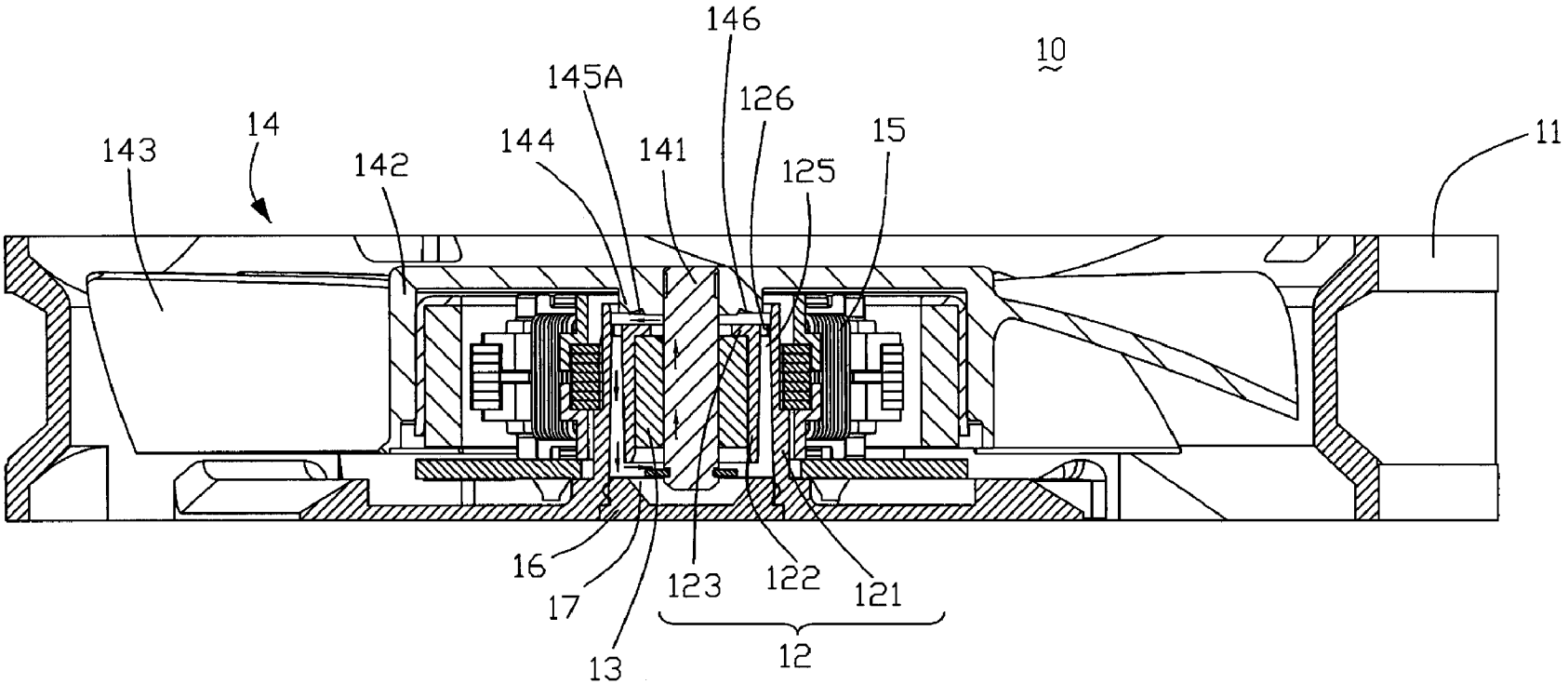
FIG. 2 is a cross-sectional view take along line II-II of FIG. 1.

Referring to FIGS. 1 and 2, a heat dissipating fan 10 includes a rectangular shaped fan frame 11, a hollow tube 12 integrally formed at a middle portion of the frame 11, a bearing 13 disposed in an inner hole of the tube 12, a rotor 14 rotatably mounted to a bearing hole of the bearing 13, and a stator 15 fixedly disposed around a periphery wall of the tube 12. A sealing cover 16 is hermetically mounted to a bottom end of the tube 12 for preventing lubricant such as oil from leakage from the bottom end of the tube 12. An oil storage space 17 is defined in the bottom end of the tube 12 between the sealing cover 16 and a bottom end of the bearing 13 for storage of the oil therein.

Figure 3:
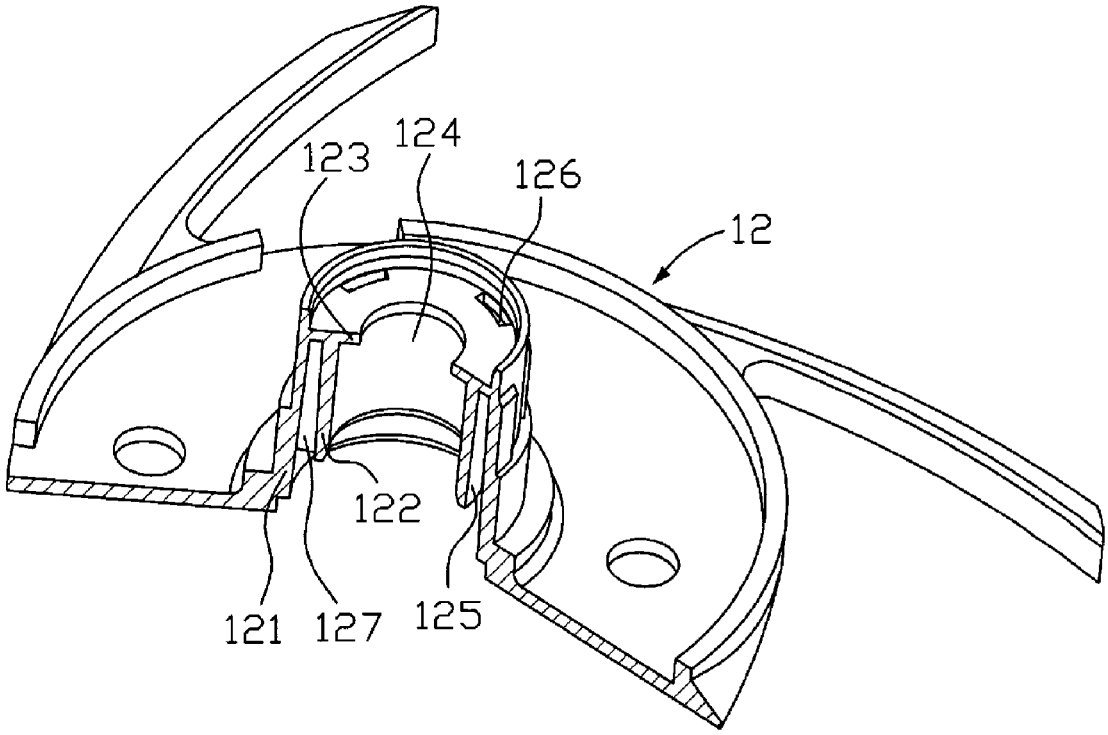
FIG. 3 is an isometric view of a tube of the fan of FIG. 1, with a part thereof being cut away.
Figure 4:
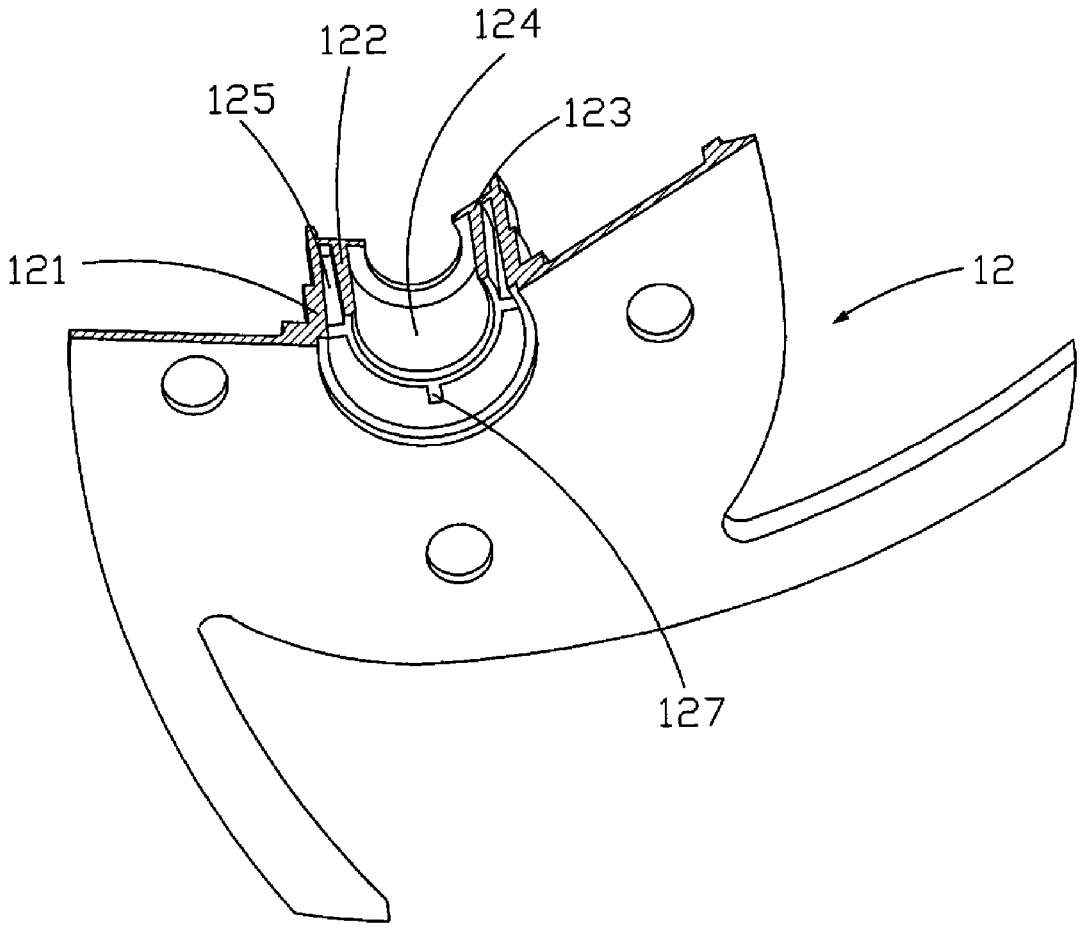
FIG. 4 is a view similar to FIG. 3, but viewed from a bottom aspect.

Referring to FIGS. 3 and 4, the tube 12 is made of plastic, and includes a tubular first wall 121 for mounting of the stator 15 thereon, a second wall 122 located inside the first wall 121 and spaced from the first wall 121 along a radial direction of the tube 12, and a ring-like connecting portion 123 formed between the first wall 121 and the second wall 122 for integrally connecting the second wall 122 to the first wall 121 at a top end thereof. The tube 12 defines a holding room 124 inside the second wall 122 for receiving the bearing 13 therein, and an oil returning space 125 between the first and second walls 121, 122. The connecting portion 123 defines therein a plurality of oil returning holes 126 communicating with the oil returning space 125 for allowing the oil to flow into the oil returning space 125 through the oil returning holes 126. The tube 12 also includes a plurality of ribs 127 in the oil returning space 125. The ribs 127 axially extend from the top end of the tube 12 towards the bottom end thereof, and radially connect the second wall 122 to the first wall 121 to thereby strengthen the second wall 122. The ribs 127 are evenly distributed between the first and second walls 121,122, and alternately spaced with the oil returning holes 126 for dividing the oil returning space 125 into a plurality of small channels (not labeled) communicating with the oil returning holes 126 and the oil storage space 17. In this embodiment, the connecting portion 123 is integrally formed with the first and second walls 121,122 via plastic injection molding.

Figure 5:
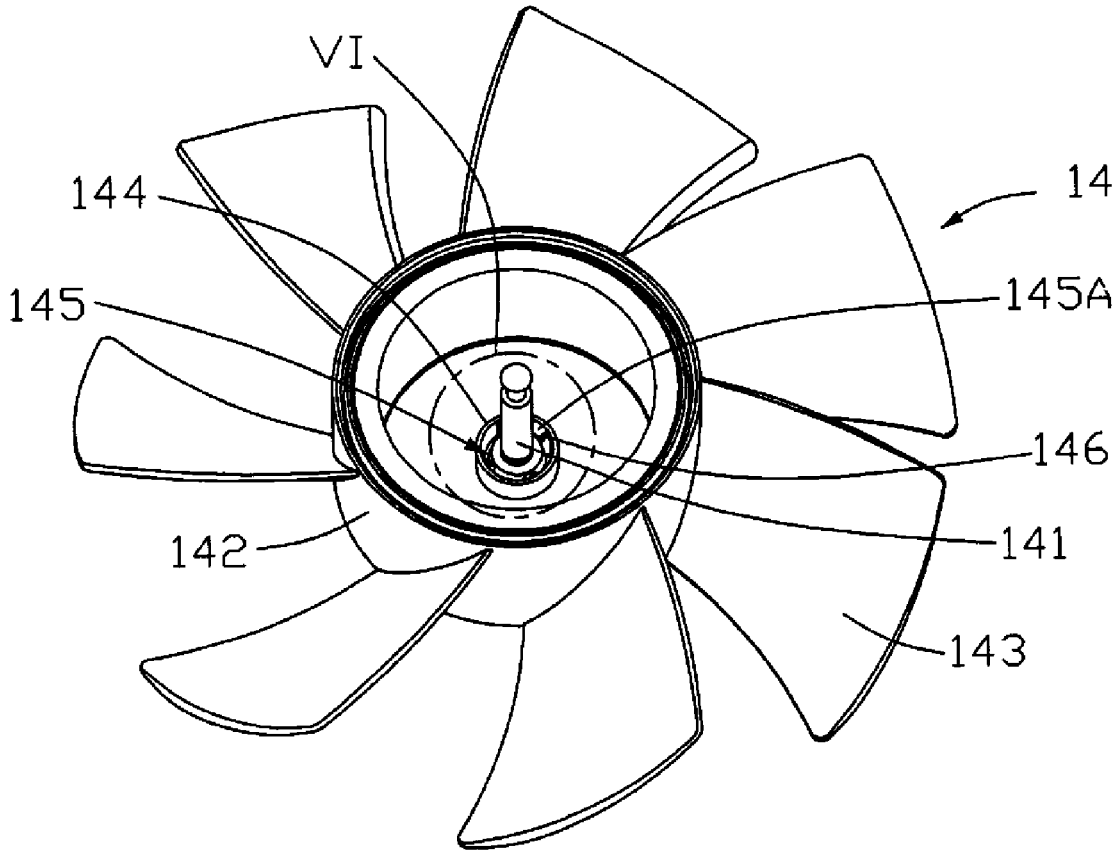
FIG. 5 is an isometric view of a rotor of the fan of FIG. 1.
Figure 6:
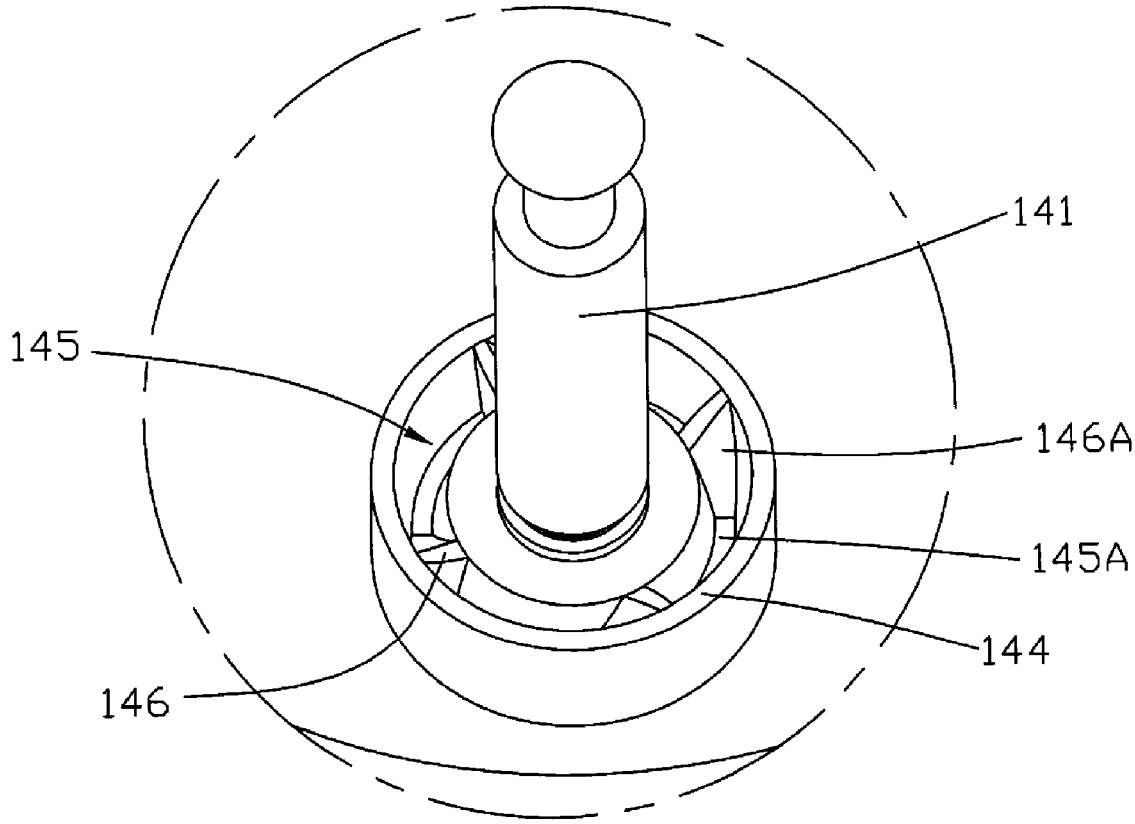
FIG. 6 is an enlarged view of a circled portion of FIG. 5 indicated by VI.

Referring to FIGS. 5 and 6, the rotor 14 includes a shaft 141 rotatably mounted in the bearing hole of the bearing 13, a hub 142 connected with the shaft 141 at a top end of the shaft 141, and a plurality of fan blades 143 radially extending from an outer periphery of the hub 142. The hub 142 includes an annular wall 144 disposed around the top end of the shaft 141. The top end of the shaft 141 is located at a central portion of the annular wall 144. An oil temporary retaining space 145 is defined between the shaft 141 and the annular wall 144 for temporarily retaining the oil therein.

The oil temporary retaining space 145 is positioned adjacent to and aligned with the connecting portion 123 of the tube 12 when the shaft 141 of the rotor 14 is mounted into the bearing 13. A plurality of oil guiding members 146 is formed in the oil temporary retaining space 145 by the hub 142, which divide the oil temporary retaining space 145 into a plurality of small spaces 145A for retaining the oil therein. A slantwise guiding surface 146A is formed on a side of each of the oil guiding members 146 facing a corresponding small space 145A, for guiding the oil retained in the corresponding small space 145A to leave therefrom.

Also referring to FIG. 2, as the fan 10 is activated, the oil retained in the oil storage space 17 is driven to flow upwardly towards a top end of the bearing 13 via a pump force caused by the relative rotation of the shaft 141 in respect to the bearing 13. When the oil is driven upwardly, it flows through a gap between the bearing 13 and the shaft 141 to lubricate both of them. Then, the oil is received in the small spaces 145A of the oil temporary retaining space 145 after it reaches the top end of the bearing 13. As the small spaces 145A of the oil temporary retaining space 145 are filled with the oil, the oil in the small spaces 145A falls down to the connecting portion 123 via the guiding surfaces 146A of the oil guiding members 146. Next, the oil flows through the oil returning holes 126 of the connecting portion 123 into the channels of the oil returning space 125. Finally the oil returns to the oil storage space 17 from the oil returning space 125. Thereafter, the oil is pumped upwards again to the oil temporary retaining space 145 to repeat the lubrication process.

In the lubrication process of a lubrication system according to the present invention, the oil stored in the oil storage space 17 goes up to the top end of the bearing 13 to be retained in the oil temporary retaining space 145, and then timely goes back to the oil storage space 17 via the oil returning space 125. Under this design, the oil will not be accumulated at the top end of the bearing 13, thereby preventing the oil from leakage from the top end of the bearing 13 and enabling the fan 10 to be sufficiently lubricated. In the lubrication system of the fan 10 according to the present invention, the oil temporary retaining space 145 is positioned adjacent to and aligned with the connecting portion 123. This ensures that the oil is not easily thrown away from the bearing 13 of the fan 10 when the oil is guided by the guiding surfaces 146A of the oil guiding members 146 located in the oil temporary retaining space 145 to fall down on the connecting portion 123, thereby ensuring that the fan 10 has a better oil retaining capability and is well lubricated. The oil returning space 125 is defined between the integrally formed first and second walls 121, 122 of the tube 12, which is formed by plastic injection molding. So the present invention does not need to form a plurality of oil returning grooves in an outer periphery wall of the bearing 13, which makes the lubrication system of the fan 10 in accordance with the present invention have a lower manufacturing cost. The bearing 13 is made of metal. To form grooves in a metal block is more complicated and expensive than to form channels by plastic injection molding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lubricating system for a fan comprising:

a lubricant storage space formed at an end portion of the fan for receiving lubricant in the lubricant storage space;

a lubricant temporary retaining space defined at another end portion of the fan for temporarily retaining the lubricant in the lubricant temporary retaining space; and a lubricant returning space communicating the lubricant storage space with the lubricant temporary retaining space, the lubricant flowing from the lubricant storage space through a gap between a bearing and a shaft of the fan to reach the lubricant temporary retaining space, and flowing from the lubricant temporary retaining space back to the lubricant storage space via the lubricant returning space when the fan is operated, wherein the lubricant returning space is defined in a tube of the fan, the tube being made of plastic with the bearing mounted therein, and a stator mounted around the tube;

wherein the lubricant temporary retaining space is enclosed by an outer surface of a top end of the shaft and an inner surface of an annular wall extending from a hub, the annular wall radially spaced from and surrounding the top end of the shaft, the top end of the shaft being secured to the hub, and a bottom end of the shaft being rotatably mounted in a bearing hole of the bearing, the hub having fan blades formed at an outer periphery wall thereof.

2. The lubricating system for a fan of claim 1, wherein the lubricant storage space is formed between a bottom end of the tube of the fan and a distal bottom end of the bearing mounted in the tube, the tube being formed at a middle portion of the fan and the bottom end of the tube being sealed by a cover.

3. The lubricating system for a fan of claim 1, wherein the lubricant temporary retaining space is divided into a plurality of small spaces via a plurality of guiding members disposed in the annular wall.

4. The lubricating system for a fan of claim 1, wherein the tube comprises a first wall and a second wall spaced with the first wall along a radial direction of the tube, and the lubricant returning space is formed between the first wall and the second wall.

5. The lubricating system for a fan of claim 4, wherein the second wall is integrally connected to the first wall at top ends of the first and the second walls via a connecting portion.

6. The lubricating system for a fan of claim 5, wherein the lubricant temporary retaining space is positioned adjacent to and aligned with the connecting portion of the tube.

7. The lubricating system for a fan of claim 5, wherein the connecting portion defines therethrough a plurality of lubricant returning holes communicating with the lubricant returning space.

8. The lubricating system for a fan of claim 7, wherein the lubricant returning space is divided into a plurality of small channels communicating with the lubricant returning holes, the small channels being defined by a plurality of ribs extending from the top ends of the first and second walls towards bottom ends of the first and the second walls.

9. A fan comprising:

a tube comprising a first wall adapted for connecting with a frame of the fan, a second wall integrally connected with the first wall at a top end of the first wall via a connecting portion, and a lubricant returning space formed between the first wall and the second wall;

a bearing disposed in the second wall of the tube;

a rotor rotatably connected with the bearing; and a lubricant storage space formed at an end portion of the tube configured for receiving lubricant in the lubricant storage space, the lubricant filled in the lubricant storage space moving to the other end portion of the tube as the rotor rotates in a bearing hole of the bearing, and returning to the lubricant storage space via the lubricant returning space;

wherein the rotor defines a lubricant temporary retaining space for temporarily retaining the lubricant therein.

10. The fan of claim 9, wherein the connecting portion is integrally formed with the first and second walls via plastic injection molding.

11. The fan of claim 10, wherein the tube further comprises a plurality of ribs between the first wall and the second wall for dividing the lubricant returning space into a plurality of channels, and the connecting portion defines therein a plurality of lubricant returning holes communicating with the channels of the lubricant returning space.

12. The fan of claim 11, wherein the ribs alternately space with the oil returning holes, making the channels of the lubricant returning space communicate with the lubricant returning holes.

13. The fan of claim 9, wherein the lubricant temporary retaining space is divided into a plurality of small spaces via a plurality of lubricant guiding members.

14. The fan of claim 13, wherein each of the lubricant guiding members forms thereon a slantwise guiding surface for guiding the lubricant leaving the lubricant temporary retaining space.

15. An electric fan comprising:

a frame;

a tube integral with the frame at a middle of the frame, the tube defining an oil returning channel therein;

a stator mounted around the tube;

a bearing mounted in the tube; and a rotor having a shaft rotatably mounted in the bearing and a plurality of fan blades;

wherein when the rotor rotates, lubricant oil stored at a bottom of the tube moves upwardly through a gap between the shaft of the rotor and the bearing to lubricate both the shaft and the bearing to reach a top of the bearing, and then the lubricant oil moves downwardly through the oil returning channel to return to the bottom of the tube; and wherein the rotor forms an annular wall surrounding a top end of the shaft to define a lubricant temporary retaining space in the rotor, a plurality of guiding members being formed in the lubricant temporary retaining space and dividing the retaining space into a plurality of small spaces, the oil entering the retaining space after reaching the top of the bearing and before moving downwardly.

16. The electric fan of claim 15, wherein the tube is made of plastic and has radially spaced first and second walls, and a connection wall integrally connects top ends of the first and second walls, the oil returning channel being defined between the first and second walls.

17. The electric fan of claim 15, wherein the tube has a hole communicating with the channel, the hole is adjacent to and aligned with the lubricant temporary retaining space.

* * * * *